United States Patent [19]

Schaeffer

[11] Patent Number: 4,799,878

[45] Date of Patent: Jan. 24, 1989

[54] RICH FUME INCINERATOR

[76] Inventor: Thomas W. Schaeffer, 5431 Sylvania Petersburg Rd., Petersburg, Mich. 49270

[21] Appl. No.: 120,667

[22] Filed: Nov. 16, 1987

[51] Int. Cl.[4] ..... F23D 14/00

[52] U.S. Cl. ..... 431/202; 110/212; 431/5; 431/38

[58] Field of Search ..... 431/5, 38, 202; 110/203, 212; 166/267

[56] References Cited

U.S. PATENT DOCUMENTS

| | | | |
|---|---|---|---|
| 3,985,494 | 10/1976 | Childree | 431/5 X |
| 4,058,147 | 11/1977 | Stary et al. | 431/5 X |
| 4,073,871 | 2/1978 | Optiz et al. | 431/5 X |
| 4,102,630 | 7/1978 | Edman | 431/38 X |
| 4,113,417 | 9/1978 | Deruelle | 431/5 |
| 4,468,193 | 8/1984 | Lawrence et al. | 431/5 X |
| 4,474,118 | 10/1984 | Benedick | 431/5 X |
| 4,680,004 | 7/1987 | Hirt | 431/5 |

*Primary Examiner*—Edward G. Favors
*Attorney, Agent, or Firm*—Thomas J. Dodd

[57] ABSTRACT

An incinerator for conserving volatile combustibles pulled from a layer of contaminated earth. The incinerator includes a burner and separate entry lines for the combustibles and the fuel with the combustible entry line terminating in the burner downstream of the fuel line. The heated combustibles therefore supply a portion of the heat to keep the burner operational. Safety features are also incorporated into the incinerator to shut off gas supply if safety conditions are violated.

13 Claims, 2 Drawing Sheets

RICH FUME INCINERATOR

SUMMARY OF THE INVENTION

This invention relates to incinerators and will have special application to incinerators used in burning volatile organic compounds.

Purging soil of volatile organic contaminants (VOC's) through vacuum technology and/or enhanced volatilization is a rapidly growing and developing art field in today's ecology minded society. While these technologies represent the most efficient and economical methods for decontaminating the soils, there are problems, particularly with regulatory agencies, regarding disposal of the VOC's once removed from the ground.

Previous methods simply called for venting of the contaminants to ambient air, a potentially hazardous procedure disclosed in U.S. Pat. Nos. 4,593,760 and 4,660,639. Other methods of contaminant control included neutralization, such as by activated carbon bed, and incineration of the VOC's. The incinerator of this invention is typically used to burn the VOC's when the concentration of VOC's being pulled from the soil is too high to make neutralization economically feasible. The incinerator is characterized by a burner connected to a source of fuel, such as propane, and further connected to a line which runs from the VOC withdrawal wells. The heat generated by the VOC's as they are pulled out of the ground is fed to the burner and acts as a fuel substitute. As a result, the incinerator can be operated on a proportionately small amount of fuel compared to conventional burners. The incinerator also includes a number of safety features not before known in the art.

Accordingly, it is an object of this invention to provide for an improved, novel incinerator.

Another object of this invention is to provide for an incinerator which is specially designed to burn VOC's removed from the soil.

Another object of this invention is to provide for a VOC incinerator which is efficient and economical.

Another object of this invention is to provide for a VOC incinerator which is safe to operate and which automatically shuts down in case hazardous conditions arise.

Other objects of this invention will become apparent upon a reading of the following description.

BRIEF DESCRIPTION OF THE DRAWINGS

A preferred embodiment of the invention has been depicted for illustrative purposes wherein.

DESCRIPTION OF THE PREFERRED EMBODIMENT

Figure 1:
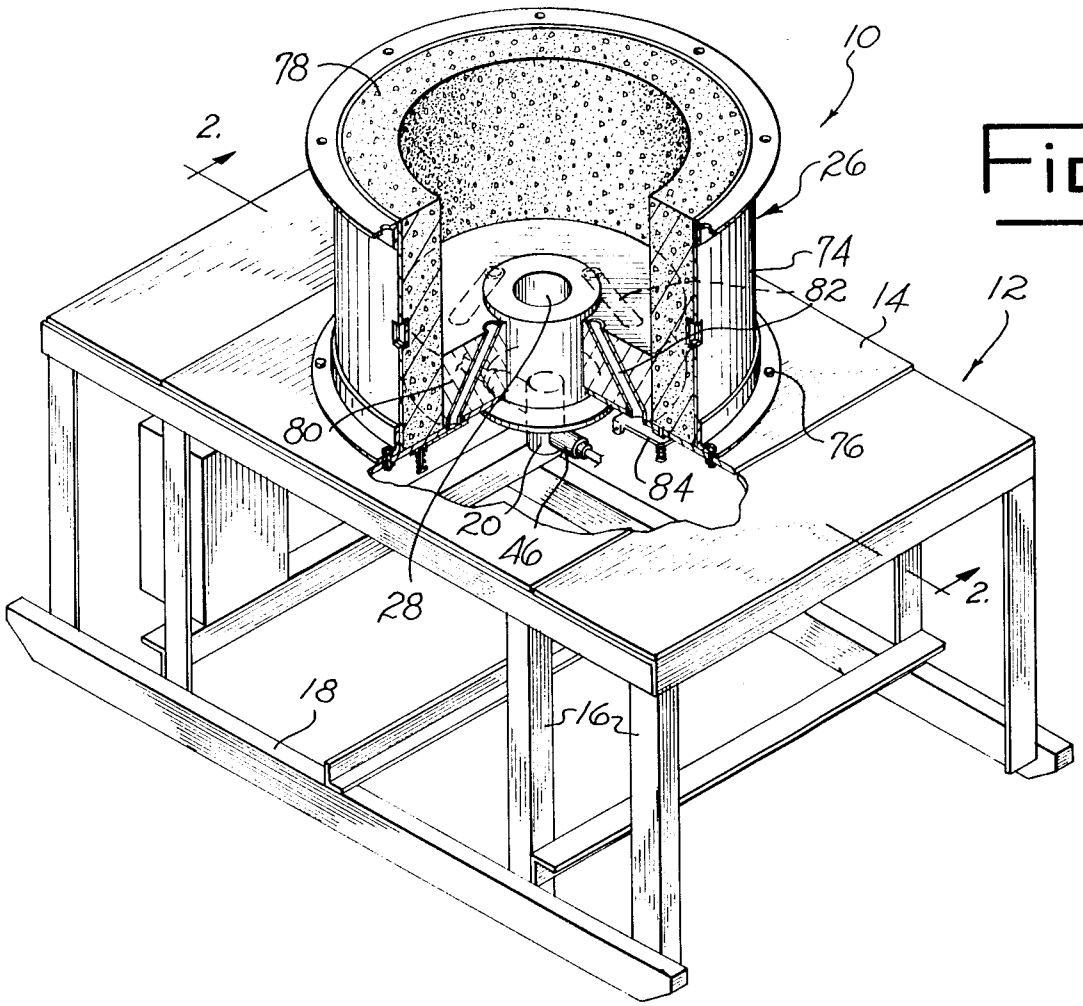
FIG. 1 is a perspective view of the incinerator with portions cut away for illustrative purposes.

The preferred embodiment herein described is not intended to be exhaustive or to limit the invention to the precise form disclosed. IT is chosen and described to explain the principles of the invention and its application and practical use to enable others skilled in the art to utilize the invention.

Referring now to the drawings, the reference numeral 10 generally refers to the incinerator of this invention. Incinerator 10 is housed principally within a frame 12 which includes platform 14 supported by legs

16 and cross braces 18 as shown in FIG. 1. Incinerator 10 includes generally a burner 20, a contaminant (VOC) supply line 22, at fuel line 24 and an exhaust stack 26. Burner 20 is of conventional construction and includes combustion chamber inlet 28 in communication with gas supply cylinder 30 which communicates with lines 22 and 24. Burner 20 may also include a light or UV scanner 32 which senses the presence or absence of flame in the burner. Scanner 32 is connected to solenoid valves 34 and 36 and serves to shut off fuel and supplies in the event the flame dies.

Figure 2:
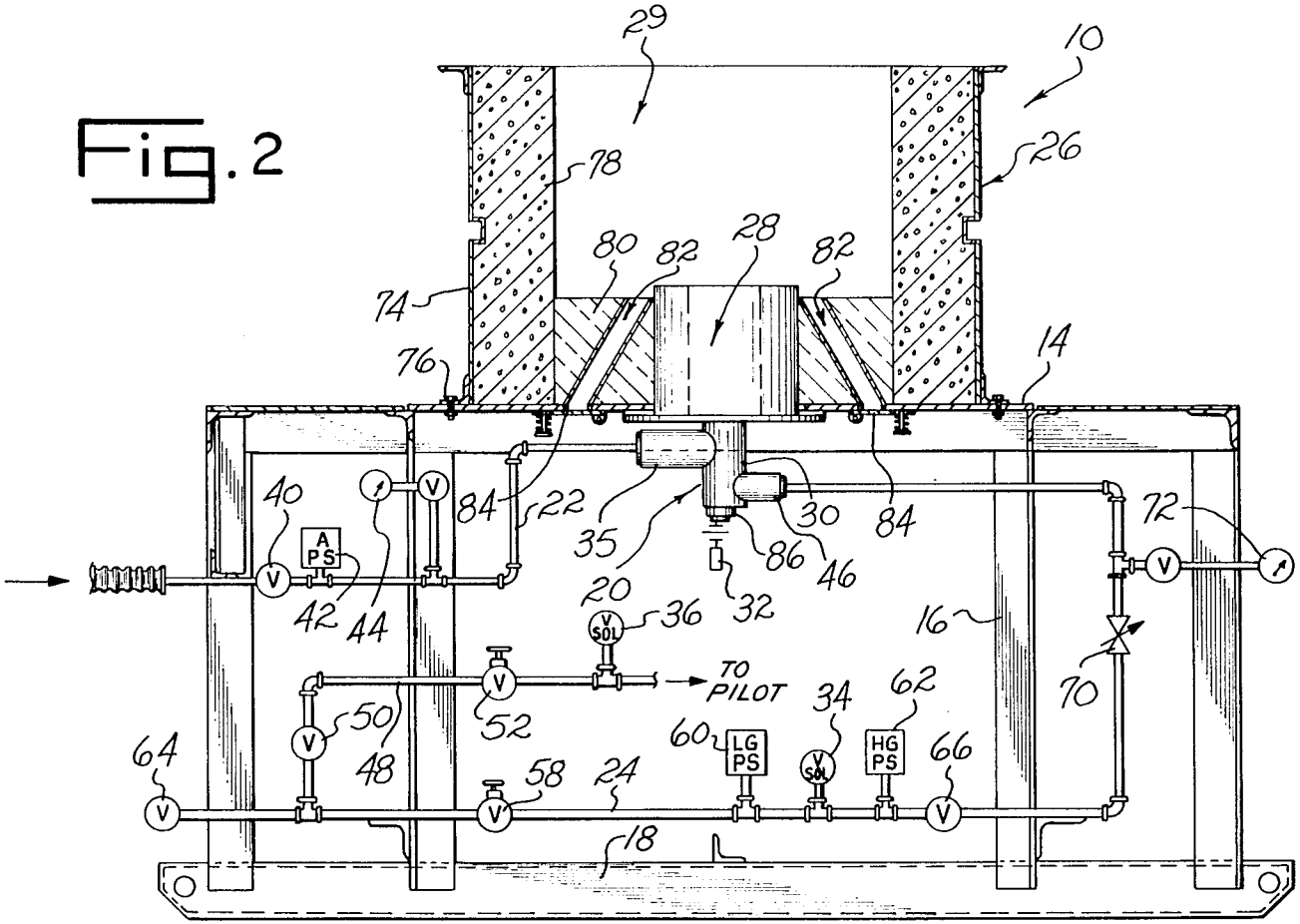
FIG. 2 is a sectional view taken along line 2—2 of FIG. 1 with the components shown in schematic form.

VOC supply line 22, as shown in FIG. 2, is in flow communication with burner 20 through outlet 35 and with a quantity of VOC's obtained from a vacuum withdrawal well (not shown). Supply line 22 includes a regulatory valve 40 and an air pressure switch 42. When the air pressure inside line 22 exceeds the set value for switch 42, the switch opens and valve 40 is closed until the pressure drops. Also in communication with line 24 is a solenoid valve 34 which shuts off fuel flow upon a signal from scanner 32 in the event the flame in burner 20 dies. Gauge 44 records the exact VOC air pressure in line 22.

Fuel line 24 is in flow communication with burner 20 through an outlet 46 and with a supply of fuel (not shown) such as propane gas. Line 24 may also include pilot line 48 which allows communication between the fuel supply (not shown) and a pilot burner (not shown) in conventional fashion through normally open valve 50, a hand operated valve 54 and solenoid valve 36 which communicates with scanner 32 to shut off gas flow to the pilot burner (not shown). Main fuel supply line 24 includes a manually operated valve 58 and low and high gas pressure switches 60, 62 in communication with solenoid valve 34 to shut off fuel flow if line pressure is too low or too high depending upon the set valve of the gas pressure switches. Line 24 may also include valves 64, 66, a gas indicating cock 70 and a pressure gauge 72.

Exhaust stack 26 as shown in FIG. 2 preferably has a metal outer cylinder 74 secured to frame platform 16 by fasteners 76. A layer 78 of insulative material is positioned within cylinder 74 as shown, and an inner layer 80 of refractory type insulative material is positioned about burner combustion chamber 29 as shown. A plurality of air passages 82 are defined in inner layer 80 as seen in FIG. 2 and each may be selectively opened and closed by a damper 84. Additional stocks (not shown) may be added atop stock 26 to increase the volume of combustion chamber 29 if necessary.

Incinerator 10 operates as follows. The VOC withdrawal pump (not shown) is activated to supply VOC's to supply line 22 and to burner 20. Fuel line 24 is opened by opening valve 58 to deliver the fuel to burner 20. An igniter 86 housed within burner 20 is then energized to ignite the VOC's and the fuel which then burn continuously in chamber 29 until fuel flow is cut off. Scanner 32 checks for the presence of flame and if no flame is present within a predetermined time (preferably not more than 1014 15 seconds) solenoid valves 34, 36 are activated to cut off VOC and fuel flow to the burner to prevent gas leakage. If a flame is present within the required time, the operator then manually sets the desired propane/air ratio by adjusting gas indicating cock 70 to the desired setting. While in operation, switches 42, 60 and 62 monitor gas and VOC pressure levels to assure safe and efficient operation. Finally, if the VOC's in lines 22 are low in oxygen content, which usually occurs during the initial withdrawal of VOC's from below the surface, air passages 82 may be opened through dampers 84 to provide extra oxygen necessary for complete combustion. Once the oxygen level in line 22 rises to an acceptable level, dampers 84 are closed to prevent excess oxygen or drafts from extinguishing the flame.

It is understood that the above description does not limit the invention to the above-given details, but may be modified within the scope of the appended claims.

What I claim is:

1. An incinerator for burning volatile organic gases, said incinerator comprising burner means including a combustion chamber for incinerating said volatile organic gases, said burner means in fluid flow communication with a fuel supply line and an organic gas material line, said volatile organic gases entering said burner means at an elevated temperature and constituting a mixture of volatile organic gases and ambient air wherein the heat of said volatile organic gases acts to heat said ambient air.

2. The incinerator of claim 1 and scanning means associated with said burner means for ascertaining the presence or absence of flame therein, said fuel supply line line including valve means operatively connected to said scanner means for cutting off fuel flow in the absence of flame in said burner means.

3. The incinerator of claim 2 wherein said valve means is a normally closed solenoid valve.

4. The incinerator of claim 1 and an exhaust stack including insulative material surrounding said burner means, said exhaust stack extending upwardly of said burner means.

5. The incinerator of claim 4 wherein said stack defines a plurality of ambient air inlets, said air inlets constituting means through which additional ambient air is delivered when needed to said combustion chamber, and damper means associated with said air inlets for selectively opening and closing the air inlets dependent upon the need for said additional ambient air.

6. The incinerator of claim 4 wherein said organic gases are volatile organic hydrocarbons.

7. The incinerator of claim 1 and means positioned along said fuel supply line for detecting the fuel pressure therein and valve means connected to said detecting means for shutting off fuel supply if the fuel pressure level exceeds or falls below a predetermined rate.

8. The incinerator of claim 1 and means positioned along said organic gas line for measuring the gas pressure therein, and valve means associated with said measuring means for shutting off supply of organic gas to the burner means if the gas pressure exceeds a predetermined rate.

9. The incinerator of claim 7 wherein said fuel supply line further includes means for adjusting the flow rate of fuel to said burner means.

10. An incinerator for burning volatile organic hydrocarbons comprising:

(a) a frame comprised of supporting horizontal and vertical frame members, and an upper platform supported by said frame members;

(b) an exhaust stack supported atop said platform and including insulative material therein;

(c) a burner which includes a combustion cylinder defining a chamber positioned within said insulative material in said exhaust stack, said burner also including an igniter;

(d) a first tube connected in flow communication to said burner, said first tube for delivering fuel to the burner; and (e) a second tube connected in flow communication to said burner downstream of said first tube, said second tube carrying a mixture of volatile organic hydrocarbons and ambient air at an elevated temperature wherein the heat of said hydrocarbons heats the ambient air necessary for combustion of said gases.

11. The incinerator of claim 10 and further including:

(f) pressure detection means connected to said first tube for detecting the fuel pressure in the first tube, and valving means connected to said pressure detection means for shutting off fuel supply when the fuel pressure exceeds or falls below a predetermined level.

12. The incinerator of claim 10 and wherein said burner further includes:

(g) a scanner means for determining the presence or absence of a flame in said burner, said scanner means connected to valve means associated with said first tube for shutting down flow of said fuel in the absence of flame in the burner.

13. The incinerator of claim 5 wherein said first-mentioned ambient air constitutes the entire supply of combustion air to said burner means when said air inlets are closed.

* * * * *